United States Patent [19]

Parrish et al.

[11] 3,930,844

[45] Jan. 6, 1976

[54] METHOD FOR DISPOSAL OF PYROTECHNIC WASTE

[75] Inventors: Clyde F. Parrish, Terre Haute; James E. Short, Jr., Switz City; Karen S. Whorrall, West Baden, all of Ind.

[73] Assignee: The United States of America as represented by the Secretary of the Navy, Washington, D.C.

[22] Filed: Feb. 6, 1975

[21] Appl. No.: 547,535

[52] U.S. Cl. ..... 75/101 R; 75/121; 423/155; 423/395

[51] Int. Cl.[2] ..... C22B 26/22

[58] Field of Search ..... 75/101 R, 121; 423/155, 423/395

[56] References Cited

UNITED STATES PATENTS

| | | | |
|---|---|---|---|
| 2,170,394 | 8/1939 | Von Zeppelin | 75/121 |
| 2,274,237 | 2/1942 | Jaeger et al. | 75/101 R X |
| 2,744,007 | 5/1956 | Giraitis et al. | 75/99 |
| 2,756,140 | 7/1956 | Giraitis et al. | 75/101 R |

*Primary Examiner*—G. Ozaki
*Attorney, Agent, or Firm*—R. S. Sciascia; Paul S. Collignon

[57] ABSTRACT

A method for disposing of tracer ammunition pyrotechnic material containing strontium nitrate, magnesium, strontium peroxide, polyvinyl chloride, calcium resinate, barium peroxide, oxamide, zinc stearate, polyethylene, strontium oxalate and lead dioxide, with strontium nitrate and magnesium accounting for about 60 percent of the total material. Strontium nitrate is first removed from the material by dissolving in cold water, and the water solution of strontium nitrate is filtered and evaporated to reclaim the strontium nitrate. The remaining material are given successive washes in hot water, ethyl alcohol and methylene chloride to remove all the other materials except magnesium. The magnesium is dried and reclaimed.

4 Claims, 2 Drawing Figures

METHOD FOR DISPOSAL OF PYROTECHNIC WASTE

BACKGROUND OF THE INVENTION

The present invention relates to a method of disposing of pyrotechnic waste and more particularly to a method for disposing of tracer ammunition.

Most tracer compositions are made from varying percentages of the same basic materials and these are, in order of quantity, strontium nitrate, magnesium, strontium peroxide, polyvinyl chloride, calcium resinate, barium peroxide, oxamide, zinc stearate, polyethylene, strontium oxalate, and lead dioxide. The strontium nitrate and magnesium account for about 60 percent of the total. Present waste treatment methods used for disposing of tracer ammunition involve burning or chemical degradation of the pyrotechnic material and produces air and water pollution.

The method used for disposing of tracer material depends on the stage of the manufacturing process when the material is scrapped. Rejected finished tracer cartridges are burned in metal containers at a burning ground. If a batch of tracer material must be discarded, it is placed in oil and burned. Dry wastes spilled during the assembly process are collected by a vacuum system, under water, and the vacuum collectors are periodically dumped and the contents are treated with caustic, water and steam in a system of sumps. The waste from the sumps are taken by truck to basins on a high hill and the degraded material is leached to the soil. As the methods presently used put degraded pyrotechnic material into the air and water, these methods are ecologically unsounded and no longer desirable.

SUMMARY OF THE INVENTION

The present invention relates to a method for disposing of tracer ammunition having a pyrotechnic composition which is about 40 percent strontium nitrate and about 24 percent magnesium. The remaining materials are strontium peroxide, polyvinyl chloride, calcium resinate, barium peroxide, oxamide, zinc stearate, polyethylene, strontium oxalate and lead dioxide. The particular materials and percentages used depend on the caliber of the ammunition and also on the particular depot which is manufacturing the ammunition. Strontium nitrate is first removed from the pyrotechnic composition by immersing the composition in water sufficiently cold so that it will only dissolve strontium nitrate. The water solution is then filtered and evaporated to reclaim the strontium nitrate. The remaining ingredients are given successive washes in hot water, in ethyl alcohol and methylene chloride. The solution is decanted after each wash and the remaining material is magnesium, which is then dried and reclaimed for subsequent use as a pyrotechnic material.

It is therefore a general object of the present invention to provide an improved method for disposing of a pyrotechnic composition without creating pollution.

Other objects, advantages and novel features of the present invention will become apparent from the following detailed description of the invention when considered in conjunction with the accompanying drawings.

DESCRIPTION OF THE PREFERRED METHOD

Figure 1:
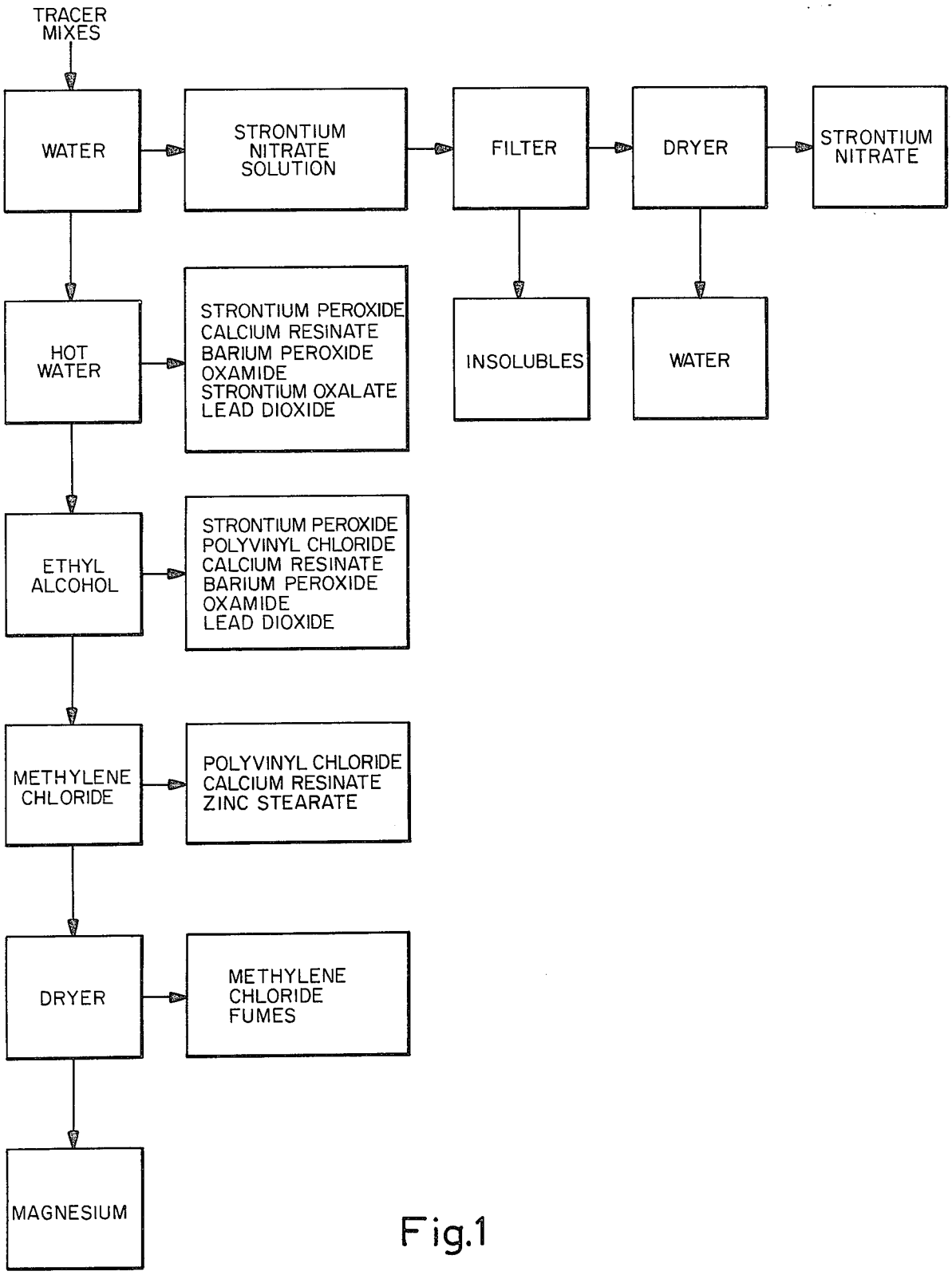
FIG. 1 is a flow-diagram showing the steps of the present invention.

Most tracer compositions are made from varying percentages of the same basic materials with strontium nitrate and magnesium accounting for about 60 percent of the total composition. In the present method, strontium nitrate and magnesium are reclaimed for use in other pyrotechnic compositions and thus the amount of pyrotechnic waste which is to be disposed is less than half. Additionally, the residual is primarily inert materials and is less hazardous than the original compositions.

Although specific materials and percentages vary for different types and sizes of tracer ammunition, the present method is designed so that all tracer compositions can be mixed together and be processed by a single method. This procedure is not only more economical, but prevents errors that could occur if a multiple number of processes were employed. The following examples show various compositions for tracer ammunition currently being manufactured by the military departments:

M62 Ammunition (7.62mm)

| | |
|---|---|
| Strontium Nitrate | 41.9% |
| Magnesium | 23.1% |
| Strontium Dioxide | 19.8% |
| Polyvinyl Chloride | 12.9% |
| Calcium Resinate | 2.3% |

M196 Ammunition (5.56mm)

| | |
|---|---|
| Strontium Nitrate | 37.4% |
| Magnesium | 26.0% |
| Strontium Dioxide | 21.1% |
| Polyvinyl Chloride | 11.5% |
| Calcium Resinate | 1.8% |
| Barium Peroxide | 1.1% |
| Lead Dioxide | 1.1% |

M25 Ammunition (.30 Cal.)

| | |
|---|---|
| Strontium Nitrate | 41.9% |
| Magnesium | 22.6% |
| Strontium Dioxide | 20.3% |
| Polyvinyl Chloride | 12.9% |
| Calcium Resinate | 2.3% |

M48 Ammunition (.50 Cal.)

| | |
|---|---|
| Strontium Nitrate | 32.4% |
| Magnesium | 23.9% |
| Strontium Dioxide | 8.6% |
| Polyvinyl Chloride | 6.9% |
| Calcium Resinate | 2.8% |
| Barium Peroxide | 23.5% |
| Strontium Oxalate | 1.6% |
| Zinc Stearate | 0.3% |

M17 Ammunition (.50 Cal.)

| | |
|---|---|
| Strontium Nitrate | 41.8% |
| Magnesium | 25.7% |
| Strontium Dioxide | 5.9% |
| Polyvinyl Chloride | 10.6% |
| Calcium Resinate | 1.9% |
| Barium Peroxide | 12.9% |
| Strontium Oxalate | 1.1% |
| Zinc Stearate | 0.1% |

M242 Ammunition (20mm)

| | |
|---|---|
| Strontium Nitrate | 34.5% |
| Magnesium | 19.8% |
| Strontium Dioxide | 22.1% |
| Polyvinyl Chloride | 12.6% |
| Calcium Resinate | 4.3% |
| Oxamide | 6.7% |

M220 Ammunition (20mm)

| | |
|---|---|
| Strontium Nitrate | 35.5% |
| Magnesium | 20.5% |
| Strontium Dioxide | 29.7% |

-continued

M62 Ammunition (7.62mm)

| | |
|---|---|
| Polyvinyl Chloride | 11.0% |
| Calcium Resinate | 3.3% |

The present invention is illustrated by the following examples:

EXAMPLE I

Twenty-five grams of M62 Ammunition was processed in order to reclaim strontium nitrate and magnesium. After the pyrotechnic tracer material was separated from the cartridge, it was first washed with cold water (13° C) and the water solution of strontium nitrate was decanted. The solution was filtered to remove some floating material and then the water was removed by heating to reclaim strontium nitrate. The reclaimed strontium nitrate was analyzed and its purity was 97.8 percent.

The remaining pyrotechnic material was washed with hot water and the solution was decanted. Next the remaining material was washed with ethyl alcohol and the solution was decanted, and finally, the remaining material was washed with methylene chloride and the solution was decanted. The remaining ingredient, which was predominately magnesium, was dried and had a purity of 86.5 percent.

EXAMPLE II

Twenty-five grams of M196 Ammunition was processed as described in EXAMPLE I, with successive washes of cold water, hot water, ethyl alcohol and methylene chloride. The reclaimed strontium nitrate had a purity of 96.1 percent and the reclaimed magnesium had a purity of 79 percent.

EXAMPLE III

Twenty-five grams of M25 Ammunition was processed as described in EXAMPLE I, with successive washes of cold water, hot water, ethyl alcohol and methylene chloride. The reclaimed strontium nitrate had a purity of 97.8 prcent and the reclaimed magnesium had a purity of 89.6 percent.

EXAMPLE IV

Twenty-five grams of M48 Ammunition was processed as described in EXAMPLE I, with successive washes of cold water, hot water, ethyl alcohol and methylene chloride. The reclaimed strontium nitrate had a purity of 92.5 percent and the reclaimed magnesium had a purity of 71.5 percent.

EXAMPLE V

Twenty-five grams of M17 Ammunition was processed as described in EXAMPLE I, with successive washes of cold water, hot water, ethyl alcohol and methylene chloride. The reclaimed strontium nitrate had a purity of 95.6 percent and the reclaimed magnesium had a purity of 86.5 percent.

EXAMPLE VI

Twenty-five grams of M242 Ammunition was processed as described in EXAMPLE I, with successive washes of cold water, hot water, ethyl alcohol and methylene chloride. The reclaimed strontium nitrate had a purity of 96.1 percent and the reclaimed magnesium had a purity of 73.7 percent.

EXAMPLE VII

Twenty-five grams of M220 Ammunition was processed as described in EXAMPLE I, with successive washes of cold water, hot water, ethyl alcohol and methylene chloride. The reclaimed strontium nitrate had a purity of 96.1 percent and the reclaimed magnesium had a purity of 84.6 percent.

EXAMPLE VIII

Seventy-five grams each of tracer mixes from M62, M196, M25, M48, M17, M242 and M220 Ammunition was placed in a 2000 ml beaker and 1500 ml of cold water was added and the mixture stirred. The liquid solution was condensed on a hot plate and precipitated. The precipitate was oven dried and a yield of 73 percent of strontium nitrate was obtained. Next 1000 ml of hot water was added to the beaker and the solution was stirred and allowed to settle. The liquid was decanted. Then 1000 ml of ethyl alcohol were added to the beaker and the solution was stirred and allowed to settle. The liquid was decanted. Then 1000 ml of methylene chloride were added to the beaker, and the solution was stirred and allowed to settle. The reclaimed magnesium was dried in an oven and a yield of 69 percent of magnesium was obtained.

The reclaimed strontium nitrate and magnesium were combined with virgin strontium dioxide, polyvinyl chloride and calcium resinate to make a tracer material having a formula as listed-above for M62 Ammunition. The mix was pressed into pellets and topped with a starter mix. Identical pellets using all virgin material was also pressed as a control. Nine pellets using reclaimed strontium nitrate and magnesium were burned and compared with nine pellets made from virgin material. The following medians were obtained:

TABLE

| | RECLAIMED MATL. | VIRGIN MATL. |
|---|---|---|
| Dominant Wave Length | 599.1 | 600.6 |
| % Purity | 95.7 | 93.8 |
| Candle Power | 2001.0 | 2751.7 |
| Burn Time | 7.82 secs. | 8.57 secs. |
| Foot Candle Seconds | 1.57 | 2.35 |

When boiling water was added to the tracer mix, after having first decanted the cold water solution, some fizzing was experienced. When a lower temperatured water of between 70° and 85°C. was used, this fizzing was eliminated and the magnesium cleaned-up equally well.

Figure 2:
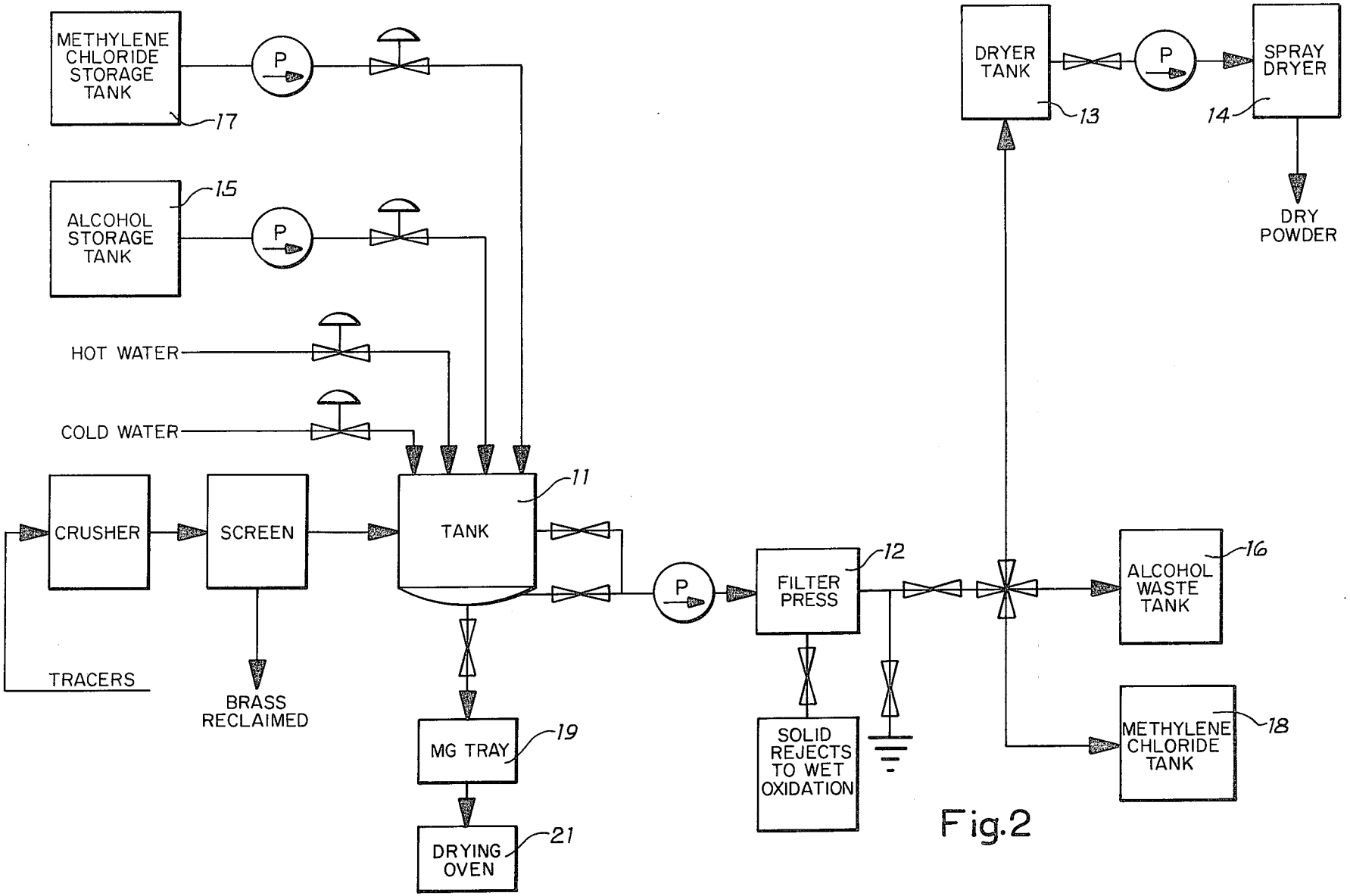
FIG. 2 is a diagram for a high production plant using the method of the present invention.

Referring now to FIG. 2 of the drawings, there is shown a diagrammatic view for a production plant utilizing the process of the present invention. Waste tracers are crushed and screened to remove the pyrotechnic material which is introduced into an agitated tank 11. Pyrotechnic material left-over from batch mixes and that material collected by collectors can be added directly to the tank. First, cold water is added to the agitated tank 11. Agitation will wet down the solids and speed dissolution of the strontium nitrate. This solution is removed through an outlet above the bottom of tank 11, leaving behind the undissolved, sinking solids. The solution is pumped through filter press 12 where floating and suspended light-weight impurities, such as calcium resinate and decomposed oxides are removed. The clarified strontium nitrate solution is collected in tank 13 and then spray dried in spray dryer 14 to give a dry powder that can be used to produce more tracers.

Next, hot water is introduced into tank 11 and the hot water washes remove more of the material other than magnesium from the remaining solids. The hot water is decanted, filtered and the liquid discarded. Then, ethyl alcohol is pumped from tank 15 into tank 11 to dissolve additional materials. The alcohol is then decanted, filtered and collected in tank 16 for recycling or reprocessing. In addition to dissolving additional materials, ethyl alcohol prevents clumping of the material that occurs when a water wash is followed by a wash with methylene chloride.

Methylene chloride is then pumped from tank 17 into tank 11 to dissolve the last of the impurities from the magnesium. The methylene chloride is decanted, filtered and stored in tank 18 for recycling or reprocessing. The bottom valve of tank 11 is then opened and magnesium flows onto trays 19 to be dried in a vented oven 21. The sludge collected by filter press 12 is washed to a storage drum to await shipment to a wet oxidation facility.

By using the present method, tracer mixes from various types of ammunition can be handled together thus significantly reducing labor costs. Also, the likelihood of failures is decreased when operators do not have to make decisions as to which process to use or where to place scrap.

Obviously many modifications and variations of the present invention are possible in the light of the above teachings. It is therefore to be understood that within the scope of the appended claims the invention may be practiced otherwise than as specifically described.

We claim:

1. A method for disposing of tracer ammunition pyrotechnic material containing strontium nitrate, magnesium, strontium peroxide, polyvinyl chloride, calcium resinate and other pyrotechnic materials, with the combined percentages of strontium nitrate and magnesium comprising at least 60 percent of the total percentage of said tracer ammunition pyrotechnic material, comprising the steps of first immersing said tracer ammunition pyrotechnic material in water sufficiently cold to dissolve only strontium nitrate, then decanting the water solution of strontium nitrate and evaporating the water to reclaim strontium nitrate, then removing all materials of said tracer ammunition pyrotechnic material other than magnesium by successive washes of hot water and solvents, and then drying the remaining magnesium for reuse as a pyrotechnic material.

2. A method of disposing of tracer ammunition pyrotechnic material as set forth in claim 1 wherein said tracer ammunition pyrotechnic material is first immersed in water having a temperature of about 13° C.

3. A method of disposing of tracer ammunition pyrotechnic material as set forth in claim 1 wherein said water solution of strontium nitrate is filtered before evaporating the water to reclaim strontium nitrate.

4. A method of disposing of tracer ammunition pyrotechnic material as set forth in claim 1 wherein said successive washes are a water wash with water having a temperature within the range of 70°–85° C., followed next by a wash with ethyl alcohol and then by a wash with methylene chloride.

* * * * *